United States Patent [19]

McMillan

[11] Patent Number: 4,468,938

[45] Date of Patent: Sep. 4, 1984

[54] TUBLESS WASHING MACHINE

[75] Inventor: Stephen L. McMillan, Louisville, Ky.

[73] Assignee: General Electric Company, Louisville, Ky.

[21] Appl. No.: 531,067

[22] Filed: Sep. 12, 1983

[51] Int. Cl.[3] ..... D06F 23/04; D06F 39/08

[52] U.S. Cl. ..... 68/23.3; 68/23 R; 68/171; 68/207; 68/208

[58] Field of Search ..... 68/23 R, 23.1, 23.3, 68/23.4, 171-174, 207, 208, 18 D

[56] References Cited

U.S. PATENT DOCUMENTS

| | | | |
|---|---|---|---|
| 2,615,320 | 10/1952 | Belaieff | 68/24 |
| 2,665,576 | 1/1954 | Thiele | 68/23 R |
| 2,784,582 | 3/1957 | Hartung et al. | 68/208 X |
| 3,493,118 | 2/1970 | Brucken | 68/23 R X |
| 3,785,181 | 1/1974 | Menk | 68/208 |
| 3,948,064 | 4/1976 | Sauer et al. | 68/23.4 |
| 3,952,557 | 4/1976 | Bochan | 68/23.3 |
| 3,958,433 | 5/1976 | Bochan | 62/23.3 |
| 4,333,322 | 6/1982 | Billings et al. | 68/23 R X |

*Primary Examiner*—Philip R. Coe

*Attorney, Agent, or Firm*—Frank P. Giacalone; Radford M. Reams

[57] ABSTRACT

A tubless washer system including a wash and drive subsystem which allows the basket to be mounted on a hollow drive shaft that provides a water conduit from the basket to the drain sump. The wash and drive subsystem is mounted on a support frame including a generally spherical bearing surface. The entire wash and drive subsystem is supported on a generally spherical surface on the cabinet base which is formed complementary to the spherical bearing surface of the subsystem.

2 Claims, 1 Drawing Figure

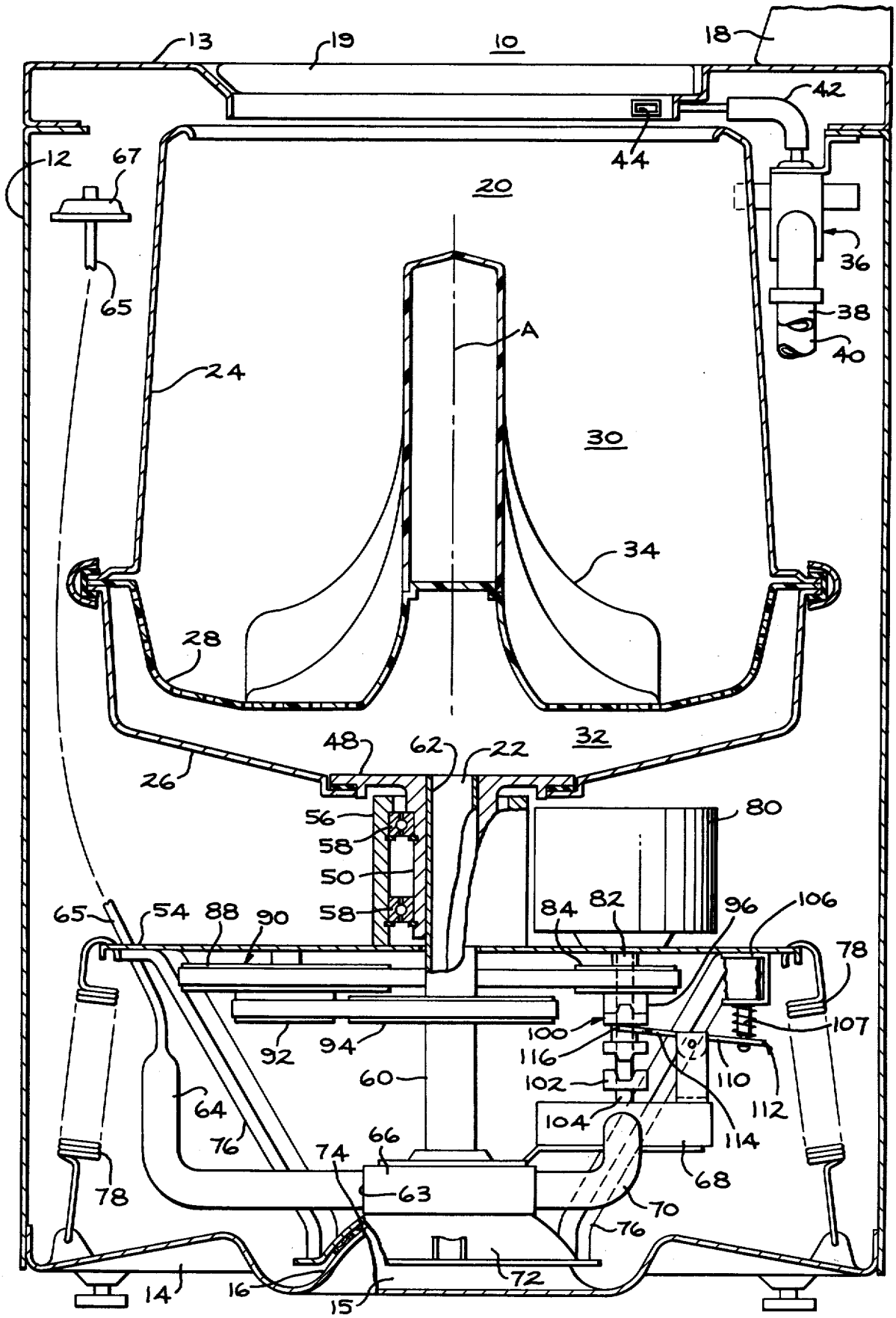
13
19
10
18
42
44
12
67
20
36
65
38
A
40
24
30
34
28
48
62
22
32
26
56
80
58
50
58
65
54
88
90
84
82
96
106
78
100
107
92
94
116
110
60
102
112
64
104
114
76
66
74
68
78
63
70
76
72
14
16
15

TUBLESS WASHING MACHINE

BACKGROUND OF THE INVENTION

The present invention relates to a clothes washing machine and more particularly to a tubless washer system including a drive subsystem which allows the basket to be mounted on a hollow shaft that provides a water conduit from the basket to the drain sump.

Conventional clothes washing machines of the vertical axis, agitator type are traditionally rather large and complex. Generally, there is provided a cabinet enclosing an outer, water-retaining tub within which is situated a clothes-retaining basket, usually having perforate walls. An agitator is mounted within this inner basket and the basket agitator assembly is coupled through a suitable power transmission with an electric motor for rotational and oscillatory motion.

Referring to U.S. Pat. Nos. 3,952,557-Bochan and 3,958,433-Bochan, assigned to the General Electric Company, the assignee of the present invention, there is disclosed a clothes washing machine employing a combination tub-washer basket which is capable of being rotated about its concentric vertical axis including a hollow shaft that provides a water conduit for removal of water from clothes during a centrifugal extraction process and which is oscillated during a washing process.

It is desirable to provide a washing machine of the vertical axis type wherein the outer water-retaining tub is eliminated, thereby resulting in a single imperforate basket for receiving both the items to be washed and the washing medium. It is also desirable to provide such a vertical axis machine that has a centrifugal water extraction capability but which has a simplified drive mechanism.

SUMMARY OF THE INVENTION

In accordance with the present invention, there is provided a vertical axis washing machine having an assembly of working parts for agitation of fabrics in a liquid during a washing cycle and centrifugal extraction of liquid from the fabrics during a draining cycle. The assembly of working parts is enclosed in a cabinet structure which includes a base. The assembly of working parts is secured to a mount including a support member and is movable therewith during operation of the machine. Means are provided for supporting the assembly of working parts relative to the cabinet including a generally spherical bearing surface formed on the cabinet base and a generally spherical lower support surface on the mount formed complementary to the shape of the bearing surface. The lower support surface is slidably mounted on the bearing surface for pivotally supporting the assembly of working parts. The machine includes a combination tub/wash basket for receiving washing liquid and fabrics to be washed including a generally circular imperforate concave base having a drain opening at the center thereof and a generally cylindrical imperforate side wall portion extending upwardly from the base. Secured within the basket above the base is a perforated divider member which divides the basket to provide an upper fabrics-retaining area for effecting washing action on the fabrics being washed and a lower basket drain area. A central hollow drive shaft is secured to the concave base of the basket. The drive shaft extends downwardly therefrom and is rotatably supported on the support member of the mount for rotation with said basket. An axially aligned sump area is arranged at the lower end of the central drive shaft. The central drive shaft is formed to include a conduit that extends from the drain opening in the basket to the axially aligned sump area for causing washing liquid to flow from the drain area of the basket to the sump area. Pump means carried by the mount includes a conduit connected to the sump area for draining liquid therefrom. Arranged on the mount is a drive means which includes an electrically reversible motor for alternatively providing oscillatory motion and rotatable motion of the basket about its vertical axis, and operable for energizing the pump means during rotatable motion. Basket drive means are provided including drive means rotatably mounted on the motor shaft which is operably connected to the central shaft for imparting rotational movement to the basket during the washing cycle. Associated with said pump means is a drive arrangement for imparting rotational movement to the pump means during the extraction cycle. Operable between the basket drive means and the pump drive means is a clutch arrangement for causing the motor to be selectively connected between the basket drive means and the pump drive means.

BRIEF DESCRIPTION OF THE DRAWINGS

The accompanying drawing is a side elevational view of a clothes washing machine broken away to show details, the view being partly in section.

DESCRIPTION OF THE PREFERRED EMBODIMENT

Referring to the drawing, there is shown a washing machine 10 of the vertical axis type which includes a cabinet 12 having a top 13 and a base 14 which is formed at its center with a portion 15 having an upper spherical surface 16 defining a support bearing. Cabinet top 13 includes a control panel 18 normally provided with a plurality of switches and controls necessary for the operation of the machine which are normally coupled into the electrical circuitry thereof (not shown). Cabinet top 13 is also provided with an access lid 19 normally hinged (not shown) for movement between a closed position as shown and an open position for gaining access into the machine for the placement therein of items of clothing to be washed.

In accordance with the present embodiment of the present invention, there is provided a combination tub-wash basket 20 arranged within washing machine cabinet 12 for oscillatory motion and concentric rotation about its vertical axis designated as A in the drawing. Wash basket 20 will receive both items such as clothes to be washed and liquid for carrying out the washing operation. The wash basket may take the general shape of a cylinder having a closed imperforate somewhat concave base, except for a single drain opening 22, and an imperforate outer side wall.

The basket 20 as shown has been formed of three components, namely: side wall portion 24, a base portion 26 and a perforate divider member 28. The base 26 is generally circular as viewed from the top plan and is concave such that the washing medium, for example water and perhaps detergent, may gravitate from the side walls inwardly toward the center drain opening 22. The base 26, as mentioned above, takes the general shape of a bowl having a somewhat concave base or bottom portion while the side wall portion 24, which may be of generally cylindrical shape, is shown in the form of a frustum of a cone having a top diameter smaller than the base diameter. This serves to hinder and generally prevent the traveling of water up the side wall during a centrifugal extraction process, wherein the wash basket spins; i.e., it rotates at a high velocity about its vertical axis.

Perforate divider 28 has been provided in the shape of an annular depression to provide an upper clothes retaining area 30 and a lower water retaining and draining area 32. A plurality of radial or helical vanes 34 are provided which may be part of the divider 28 for imparting washing action to items being washed. Means are provided for coupling to a source of hot and cold water in the form of a solenoid operated valve system 36 having inlets 38 and 40 for coupling respectively to cold and hot water. Solenoid operated valve system 36 is, in essence, a water mixing valve and is operable in response to settings made in control panel 18 and is coupled to a hose 42 by a nozzle 44 communciating with the basket 20 for supplying the necessary water thereto for effecting wash and rinse operations.

As has been mentioned, wash basket 20 is mounted for oscillation and rotation about its concentric vertical axis. An annular flange support member 48 is provided in a portion of the base 26 to provide rigidity and strength to the wash basket 20. Support member 48 is suitably secured to base 26 in a water-tight manner for rotational movement with basket 20. The member 48 is rotationally supported on a mount plate or platform member 54. To this end, the support member 48 includes a tubular downwardly extending portion 50 coaxially arranged in housing 56 which is secured to the member 54. The portion 50 of member 48 is rotatably supported in housing 56 by upper and lower bearings 58. Secured circumferentially to the member 50 for rotation therewith is a tubular drive shaft 60. The shaft 60 includes a central drain conduit 62 that is axially aligned with the drain opening 22 in the base portion 26 of basket 20. The tubular drive shaft 60 extends downwardly through platform 54 and terminates with its lower open end in a sump area 66. A drain pump 68 is secured to the platform 54 and is connected to the sump area 66 by a conduit 70 for draining the machine in a manner to be explained hereinafter.

As thus far described, water delivered to the basket 20 through solenoid valve system 36 after passing through the items being washed flows through the perforations of the divider 28. The water and any sediment such as sand is free to flow into the bottom drain area 32 of the basket 20 and thence into the conduit 62 of shaft 60 to sump 66. Water drained into the sump 66 is then drained through conduit 70 and pump 68. A rotary seal (not shown) may be provided between the rotatable shaft 60 and the stationary sump area 66.

The level to which water rises in basket 20 may be controlled by any suitable liquid level sensing means. One typical arrangement for doing this is to provide an opening 63 in the side of sump 66. Opening 63 is connected through a conduit 64 and a tube 65 to a conventional pressure sensitive switch 67. In conventional manner, as the water fills the sump 66 and conduit 62 and rises in basket 20, it exerts increasing pressure on the column of air trapped in tube 65. At a predetermined pressure level, the column of air then operates the pressure sensitive switch 67 to shut off the water inlet valve assembly 36, at which time the washing cycle of operation can start.

The support system for the wash and drive subsystem is of the well known gyratory type. To this end, the sump area 66 has rigidly secured thereto a spherically shaped dish 72 having a bearing surface 74 which is complementary in shape to the bearing surface 16 of the base 14. The surfaces 16 and 74 form a damped gyratory suspension system. The dish 72 is rigidly connected to the platform 54 by equally spaced support arms or struts 76. It is expected that there would normally be supplied those such struts equally spaced around the periphery of the platform 54 and dish 72 so that all of the wash and drive subsystem is in effect supported through dish 72 on the platform 54 and pivotal about a node generated by the spherical surfaces 16 and 74. Also provided as part of the suspension system are a plurality of centering and damping springs 78 coupled between the platform 54 and the machine base 14. Like the struts it is expected that three equally spaced springs would be normally supplied. However, this is not absolute and more may be provided should the need arise.

The drive system for the basket 20 and pump 68 includes an electrically commutated reversible motor 80 which is mounted on the platform 54 with its shaft 82 extending downwardly therethrough. The basket 20 is driven through a pulley system including a pulley 84 rotatably mounted on the motor shaft 82. The pulley 84 is belted to one pulley 88 of a compound idler pulley 90 which is rotatably secured to the platform 54. The second pulley 92 is belted to a pulley 94 secured to the shaft 60. The compound pulley 90 is used to reduce the drive ratio between the motor 80 and shaft 60. To this end, pulley 88 is larger than the drive pulley 84 and pulley 94 is, in turn, larger than its driving pulley 92. This arrangement produces the high torque-low speed required to effect the washing operation. The pulley 84 is driven by motor 80 through a drive latch member 96 which is secured thereto. Slidably mounted on the motor shaft 82 for rotation therewith is an axially movable clutch member 100 which is movable to a first or upper position for engaging the drive member 96 secured to the pulley 84 and to a second lower position for engaging a drive member 102 secured to shaft 104 of pump 68. The clutch member 100 is shifted by action of a solenoid 106 which has its armature 108 connected to one arm 110 of a bell crank 112. The other arm 114 of bell crank 112 includes a yoke or bifurcated end 116 which straddles the clutch member 100. Energization of solenoid 106 shifts the clutch member 100 between its first and second positions to cause the motor 80 to impart rotational movement to either the basket 20 through the pulley system during a washing operation or to the pump 68 during an extraction operation, respectively.

The use of an electrically commutated reversible motor allows the basket to be either cyclically oscillated or undirectionally rotated. This eliminates the need for motion converting mechanisms, multiple drive path transmissions or variable speed transmissions normally used in washing operations.

In operation of the machine during the washing cycle, the clutch member 100 is in engagement with drive member 96 of pulley 84. Oscillation of the basket is accomplished by cyclically reversing the motor with the shaft 60 being driven through the pulley system, imparting an agitation action to the clothes in basket 20. The extraction cycle of operation is preceded by a drain down and, accordingly, the clutch member 100 is moved into engagement with the drive member 102 to drive pump 68. After the drain down, the member 100 is again shifted into engagement with drive member 96 to spin the basket at high speed, causing water to be extracted from the clothes being washed. During spin, extracted water collects on the outer wall 24 and flows down into portion 32 of basket 20 below the divider 28. Stopping rotation of the basket and reshifting member 100 into engagement with drive member 102 to restart drain down allows the water to flow to the center opening 22 and into the sump 66. Spin extraction is then alternated with drain down to remove most of the residual water from the clothes.

The foregoing is a description of the preferred embodiment of the apparatus of the invention and it should be understood that variations may be made thereto without departing from the true spirit of the invention as defined in the appended claims.

What is claimed is:

1. A vertical axis washing machine having an assembly of working parts for agitation of fabrics in a liquid during a washing cycle and centrifugal extraction of liquid from the fabrics during a draining cycle;

a cabinet structure including a base enclosing the assembly of working parts;

a mount including a support member secured to the assembly of working parts being adapted to move therewith during operation of the machine;

means for supporting said assembly of working parts including a generally spherical bearing surface formed on said cabinet base and a generally spherical lower support surface on said mount formed complementary to the shape of said bearing surface on said base being slidably mounted therein for pivotally supporting said assembly of working parts;

a combination tub/wash basket for receiving washing liquid and fabrics to be washed including a generally circular imperforate concave base having a drain opening at the center thereof and a generally cylindrical imperforate side wall portion extending upwardly from said base;

a perforated divider member secured within the basket above the base dividing said basket to provide an upper fabrics retaining area for effecting washing action on the fabrics being washed and a lower basket drain area;

a central shaft secured to said concave base of said basket extending downwardly therefrom being rotatably supported on said support member of said mount for rotation with said basket;

an axially aligned sump area arranged at the lower end of said central shaft;

a conduit in said central shaft extending from said drain opening to said axially aligned sump area for causing washing liquid to flow from said drain area to said sump area;

pump means carried by said mount including a conduit connected to said sump area for draining liquid from said sump area;

drive means on said mount including an electrically reversible motor for alternatively providing oscillatory motion and rotatable motion of the basket about its vertical axis;

basket drive means including means rotatably mounted on said motor shaft operably connected to said central shaft for imparting oscillating movement to said basket during said washing cycle and for imparting rotational movement to said pump means during said draining cycle;

pump drive means associated with said pump means for imparting rotational movement to said pump means; and clutch means operable between said basket drive means and said pump drive means for causing said motor to be selectively connected between said basket drive means and said pump drive means.

2. The vertical axis washing machine recited in claim 1 further comprising means for supplying water to said basket, and a water fill control means including means operative after a predetermined level of water is in said basket for terminating said water supply means.

* * * * *